US007510370B2

(12) United States Patent
Strangman et al.

(10) Patent No.: US 7,510,370 B2
(45) Date of Patent: Mar. 31, 2009

(54) TURBINE BLADE TIP AND SHROUD CLEARANCE CONTROL COATING SYSTEM

(75) Inventors: Thomas E. Strangman, Prescott, AZ (US); Derek Raybould, Denville, NJ (US); Paul Chipko, Blairstown, NJ (US); Malak F. Malak, Tempe, AZ (US)

(73) Assignee: Honeywell International Inc., Morristown, NJ (US)

( * ) Notice: Subject to any disclaimer, the term of this patent is extended or adjusted under 35 U.S.C. 154(b) by 502 days.

(21) Appl. No.: 11/227,780

(22) Filed: Sep. 14, 2005

(65) Prior Publication Data

US 2008/0166225 A1 Jul. 10, 2008

Related U.S. Application Data

(60) Provisional application No. 60/648,781, filed on Feb. 1, 2005.

(51) Int. Cl.
*F01D 5/20* (2006.01)

(52) U.S. Cl. ..... 415/173.4; 415/174.4

(58) Field of Classification Search ..... 415/9, 415/173.1, 173.4, 174.4, 200
See application file for complete search history.

(56) References Cited

U.S. PATENT DOCUMENTS

| | | | | |
|---|---|---|---|---|
| 3,508,890 | A * | 4/1970 | Fontanella | 428/621 |
| 4,299,638 | A | 11/1981 | Matsuhisa | |
| 4,422,648 | A * | 12/1983 | Eaton et al. | 277/415 |
| 4,606,699 | A | 8/1986 | Hemsworth | |
| 4,669,955 | A * | 6/1987 | Pellow | 415/173.4 |
| 4,744,725 | A * | 5/1988 | Matarese et al. | 415/173.4 |
| 4,764,089 | A | 8/1988 | Strangman et al. | |
| 4,854,196 | A | 8/1989 | Mehan | |
| 4,914,794 | A | 4/1990 | Strangman et al. | |
| 5,059,095 | A | 10/1991 | Kushner et al. | |
| 5,178,519 | A | 1/1993 | Kawasaki et al. | |
| 5,474,421 | A | 12/1995 | Rossmann | |
| 5,512,382 | A * | 4/1996 | Strangman | 428/632 |
| 5,704,759 | A | 1/1998 | Draskovich et al. | |
| 5,952,110 | A | 9/1999 | Schell et al. | |
| 5,997,248 | A | 12/1999 | Ghasripoor et al. | |
| 6,132,175 | A | 10/2000 | Cai et al. | |
| 6,190,124 | B1 | 2/2001 | Freling et al. | |
| 6,435,824 | B1 | 8/2002 | Schell et al. | |
| 6,482,537 | B1 | 11/2002 | Strangman et al. | |
| 6,699,604 | B1 | 3/2004 | Li et al. | |
| 2003/0132119 | A1 * | 7/2003 | Ohara et al. | 205/109 |
| 2003/0132199 | A1 | 7/2003 | Hu et al. | |

(Continued)

FOREIGN PATENT DOCUMENTS

JP 2023203 A 8/1989

*Primary Examiner*—Edward Look
*Assistant Examiner*—Nathaniel Wiehe
(74) *Attorney, Agent, or Firm*—Ingrassia, Fisher & Lorenz, P.C.

(57) ABSTRACT

A turbine blade tip and shroud clearance control coating system comprising an abrasive blade tip coating and an abradable shroud coating are provided. The abrasive layer may comprise abrasive particles of cubic zirconia, cubic hafnia or mixtures thereof, and the abradable layer may be a nanolaminate thermal barrier coating that is softer than the abrasive layer. The invention further provides an alternate coating system comprising an abradable blade tip coating and an abrasive shroud coating.

20 Claims, 3 Drawing Sheets

U.S. PATENT DOCUMENTS

2004/0067317 A1 4/2004 Gorman
2004/0115351 A1 6/2004 Lau et al.
2005/0003172 A1 1/2005 Wheeler et al.
2005/0079343 A1* 4/2005 Raybould et al. ..... 428/336

* cited by examiner

TURBINE BLADE TIP AND SHROUD CLEARANCE CONTROL COATING SYSTEM

CROSS REFERENCE TO RELATED APPLICATIONS

This application claims the benefit of U.S. Provisional Application No. 60/648,781 filed Feb. 1, 2005, the disclosure of which is incorporated by reference herein.

GOVERNMENT RIGHTS

This invention was made with Government support under F33615-01-C-5233 awarded by the U.S. Air Force. The Government has certain rights in this invention.

BACKGROUND OF THE INVENTION

The present invention relates generally to coating systems for turbine blades and shrouds for gas turbine engines.

Gas turbine engines typically include a variety of rotary seal systems to maintain differential working pressures that are critical to engine performance. One common type of seal system includes a rotating blade positioned in a rub relationship with the inner surface of a shroud. With the operation of a gas turbine engine, blade tip wear during rubs with the shroud along with blade tip oxidation can reduce blade tip height and increase the blade tip to shroud clearance. Increased blade tip clearance reduces turbine performance and performance retention during the service of the gas turbine engine, resulting in an increase in the expense of operation and maintenance of the engine.

Several rotary seal systems to minimize the blade tip to shroud clearance have been described in the prior art. The prior art systems basically have blades with ceramic coated tips that have the ability to abrade the inner surface of the shroud. One system, disclosed in U.S. Pat. No. 5,059,095 has a blade with a ceramic blade tip layer where the layer consists of aluminum oxide and zirconia-based oxide. U.S. Pat. No. 6,190,124 discloses a system having a blade with an abrasive tip that is harder than an abradable inner shroud surface. The blade tip has a metal bond coat, an aluminum oxide layer disposed on the metal bond coat, and a zirconium oxide abrasive coat disposed on the aluminum oxide layer where the zirconium oxide abrasive coat has a columnar structure. However, while these rotary seal systems are an improvement over a blade and shroud with no abrasive or abradable coatings, respectively, none of the systems attempt to minimize the rubbing friction between the abrasive and abradable surfaces during engine operation. Such friction may result in bending stresses that overload the blade to failure.

As can be seen, there is a need for a rotary seal system for gas turbine engines that minimizes the friction of rubbing between the blade tip and the inner surface of the shroud. Such a rotary seal system should also maintain a minimum clearance between the blade tip and the inner surface of the shroud.

SUMMARY OF THE INVENTION

In one aspect of the present invention there is provided a turbine blade tip and shroud clearance control coating system comprising a turbine blade, the turbine blade comprising a blade tip; an abrasive grit coating disposed on the blade tip, the abrasive grit coating comprising an oxidation resistant bond coating and grit particles embedded into the oxidation resistant bond coating, wherein the grit particles comprise abrasive crystalline particles of cubic zirconia, cubic hafnia or mixtures thereof; a turbine shroud, the shroud comprising an inner surface, wherein the inner surface is in a rub relationship with the blade tip; and a nanolaminate thermal barrier coating on the inner surface of the turbine shroud, the nanolaminate thermal barrier coating comprising alternating layers of a first material with a second material, the first material comprising stabilized zirconia, hafnia or mixtures thereof, and the second material comprising at least one metal oxide.

In another aspect of the present invention there is provided a turbine blade tip and shroud clearance control coating system comprising a silicon nitride turbine blade, the turbine blade comprising a blade tip; an abrasive grit coating disposed on the blade tip, the abrasive grit coating comprising; an oxidation resistant bond coating, the oxidation resistant bond coating comprising a refractory metal silicide braze; and grit particles embedded into the oxidation resistant bond coating, wherein the grit particles comprise abrasive crystalline particles of cubic zirconia, cubic hafnia or mixtures thereof; a turbine shroud, the shroud comprising an inner surface, wherein the inner surface is in a rub relationship with the blade tip; and a nanolaminate thermal barrier coating on the inner surface of the turbine shroud, the nanolaminate thermal barrier coating comprising alternating layers of a first material with a second material, the first material comprising stabilized zirconia, stabilized hafnia or mixtures thereof, and the second material comprising at least one metal oxide.

In a further aspect of the present invention there is provided a turbine blade tip and shroud clearance control coating system comprising a turbine blade, the turbine blade comprising a blade tip; an abradable tip coating disposed on the blade tip, the abradable tip coating comprising an oxidation resistant refractory metal silicide braze, an alloyed tantalum oxide, or a nanolaminate thermal barrier coating; a turbine shroud, the shroud comprising an inner surface, wherein the inner surface is in a rub relationship with the blade tip; and an abrasive shroud coating on the inner surface of the turbine shroud, the abrasive shroud coating comprising stabilized tetragonal or cubic zirconia, stabilized tetragonal or cubic hafnia or mixtures thereof.

In yet another aspect of the present invention, there is provided a turbine blade tip coating system comprising a turbine blade, the turbine blade comprising a blade tip; and an abrasive grit coating disposed on the blade tip, the abrasive grit coating comprising an oxidation resistant bond coating and grit particles embedded into the oxidation resistant bond coating, wherein the grit particles comprise abrasive crystalline particles of cubic zirconia, cubic hafnia or mixtures thereof.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention provides a turbine blade tip and shroud clearance control coating system which may comprise an abrasive coating on the blade tip and an abradable, nanolaminate thermal barrier coating on the inner surface of a shroud. The present invention may be used in gas turbine engines that require tight clearances between the blade tip and the inner surface of the shroud, particularly engines which operate in high heat environments and/or high wear applications.

The turbine blade tip and shroud clearance control coating system (referred to as the "coating system" herein) of the present invention may combine a blade tip having an abrasive coating with a turbine shroud having a nanolaminate thermal barrier coating on the inner surface of the shroud or, conversely, an abrasive coating on the inner surface of the shroud and a complementary abradable thermal barrier coating on the blade tip. The abrasive blade tip coating may comprise particles of cubic zirconia, cubic hafnia or mixtures thereof embedded in an oxidation resistant bond coating. The nanolaminate thermal barrier coating may have hundreds to thousands of layers having layer interfaces decorated with a softer shearable constituent material, allowing the coating on the inner surface of the shroud to be easily abraded by the abrasive coating during turbine engine operation. In contrast to the coating system of the present invention, which may have cubic zirconia and/or cubic hafnia as the abrasive material, a number of prior art systems have embedded cubic boron nitride as the abrasive material in the tip coating. Cubic boron nitride is readily oxidized at higher temperatures, thereby limiting its use in applications where a turbine engine operates at high temperatures, i.e., greater than 2500° F. Moreover, the prior art systems do not provide a specific, complementary abradable coating, irrespective of the abrasive coating. In contrast, the coating system of the present invention provides an abradable nanolaminate thermal barrier coating that complements the abrasive coating.

Figure 1:
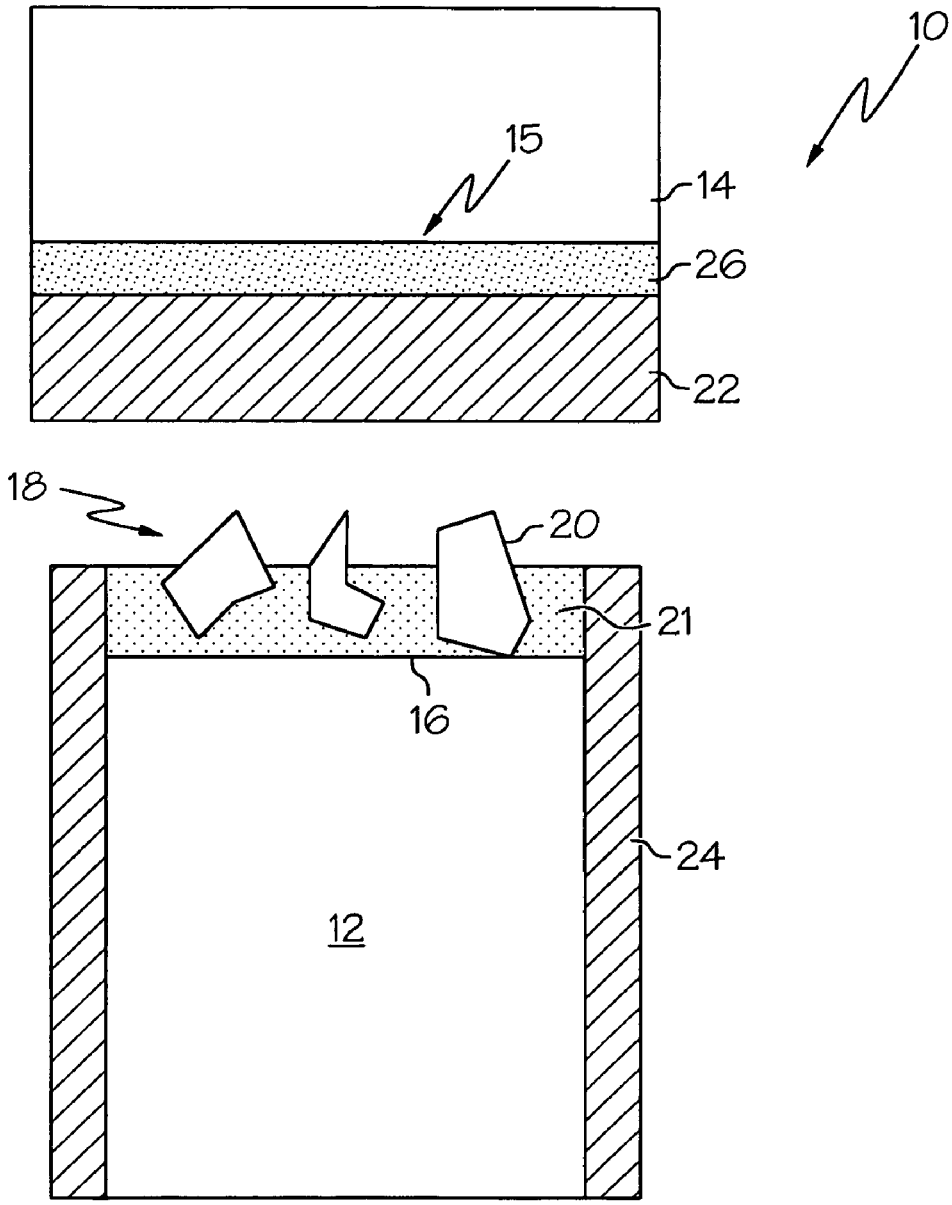
FIG. 1 shows a cross-section of a turbine blade and shroud of a gas turbine engine, according to one embodiment of the invention.

Referring to FIG. 1, there is shown a turbine blade tip and shroud clearance coating system 10 which may comprise a turbine blade 12 and a turbine shroud 14. Turbine blade 12 may comprise a turbine blade tip 16 and an abrasive grit coating 18 on turbine blade tip 16 where abrasive coating 18 may comprise grit particles 20 embedded in an oxidation resistant bond coating 21. Turbine blade 12 may optionally further comprise an environmental barrier coating (EBC) or a thermal barrier coating (TBC) 24 for added protection of turbine blade 12. Turbine shroud 14 may comprise an inner surface 15, where inner surface 15 may be in a rub relationship with turbine blade tip 16, and a nanolaminate thermal barrier coating (NTBC) 22 applied to inner surface 15. NTBC 22 may comprise at least one abradable layer.

Abrasive grit coating 18 may comprise grit particles 20 where grit particles 20 may comprise abrasive crystalline particles of cubic hafnia, cubic zirconia, or mixtures thereof. In one illustrative embodiment abrasive grit coating 18 has a thickness of from about 50 μm to about 200 μm. Grit particles 20 may be embedded in an oxidation resistant bond coating 21. In one illustrative embodiment, the abrasive crystalline particles may have a diameter of from about 50 μm to about 200 μm. Crystalline cubic zirconia or cubic hafnia may be hard enough to abrade the NTBC 22 on the turbine shroud 14 while being resistant to oxidation and melting at temperatures greater than about 3,000° F. Therefore, unlike cubic boron nitride of the prior art, cubic zirconia and/or cubic hafnia may be used in coating system 10 for high-temperature applications.

Abrasive grit coating 18 may further comprise an oxidation resistant bond coating 21 in which the abrasive crystalline particles are embedded. The oxidation resistant coating may be any coating that protects the base material turbine blade 12 from oxidation during engine operation. The oxidation resistant coating may also be compatible with a base material of the turbine blade so that it will strongly bond or adhere to turbine blade 12. In one illustrative embodiment, turbine blade 12 may comprise silicon nitride and the oxidation resistant bond coating 21 may be a refractory metal silicide braze such as, but not limited to, $TaSi_2$+Si. In an alternate illustrative embodiment, turbine blade 12 may comprise a nickel-based superalloy and the oxidation resistant bond coating 21 may comprise a Pt-aluminide coating, a NiCoCrAlY coating or a NiCrAlY coating.

Abrasive grit coating 18 may be applied to blade tip 16 by any method known to the skilled artisan. By way of non-limiting example, abrasive girt coating 18 may be applied by entrapping grit particles 20 in a silicide braze. Alternatively, abrasive girt coating 18 may be applied by entrapping grit particles 20 in an electroplated metallic matrix. For example, the metallic matrix may be electroplated nickel or electroplated nickel that entraps a dispersion of fine CrAlY intermetallic particles. The electroplated Ni matrix with entrapped intermetallic particles may be subsequently heat treated to form an oxidation resistant NiCrAlY matrix. Alternatively, an electroplated Ni matrix may subsequently be electroplated with a thin layer of platinum and then aluminized by a chemical vapor deposition process to form an oxidation resistant Pt-aluminide coating matrix.

Turbine shroud 14 may comprise an inner surface 15 and a nanolaminate thermal barrier coating (NTBC) 22 applied to inner surface 15. Turbine shroud 14 may further comprise an inner layer 26 disposed directly on inner surface 15 and NTBC 22 may be disposed directly on inner layer 26. Inner layer 26 may comprise a bond coating, an environmental barrier layer, or a second thermal barrier coating. NTBC 22 may be softer than abrasive grit coating 18 so that NTBC 22 may be abraded by turbine blade tip 16 comprising abrasive grit coating 18. NTBC 22 may comprise hundreds to thousands of deposition interfaces, or layers, decorated with a softer shearable constituent material such as, but not limited to, tantalum oxide. In one illustrative embodiment, NTBC 22 may comprise hundreds of alternating layers of a first material with a second material, the first material comprising stabilized zirconia, hafnia or mixtures thereof, and the second material comprising a softer material such as, but not limited to, at least one metal oxide. The metal oxide may be, but is not limited to, tantalum oxide, alumina, niobium oxide or mixtures thereof. The stabilized zirconia and/or hafnia may be yittrium-stabilized zirconia and/or yittrium-stabilized hafnia. In one illustrative embodiment, nanolaminate TBC 22 may comprise from about 30 wt % to about 95 wt % stabilized zirconia, hafnia or mixtures thereof, and from about 5 wt % to about 70 wt % of a metal oxide, where the metal oxide may be, but is not limited to, tantalum oxide, alumina, niobium oxide or mixtures thereof. In another illustrative embodiment, nanolaminate TBC 22 may comprise from about 5 wt % to about 25 wt % metal oxide and from about 75 wt % to about 95 wt % of stabilized zirconia, hafnia or mixtures thereof. In one illustrative embodiment, NTBC 22 may be the nanolaminate TBC disclosed in commonly assigned U.S. Pat. No. 6,482,537 (the '537 patent), the disclosure of which is incorporated herein by reference. The nanolaminate TBC of the '537 patent was developed as a protective coating for preventing damage to turbine blades and shrouds at high operating temperatures. It has been found, however, that the nanolaminate TBC of the '537 patent may be an excellent abradable coating for the turbine shroud 14 in conjunction with the abrasive grit coating 18 of the turbine blade tip 16. Constituent oxides of the NTBC 22 may have melting temperatures in excess of about 3000° F.

Figure 2:
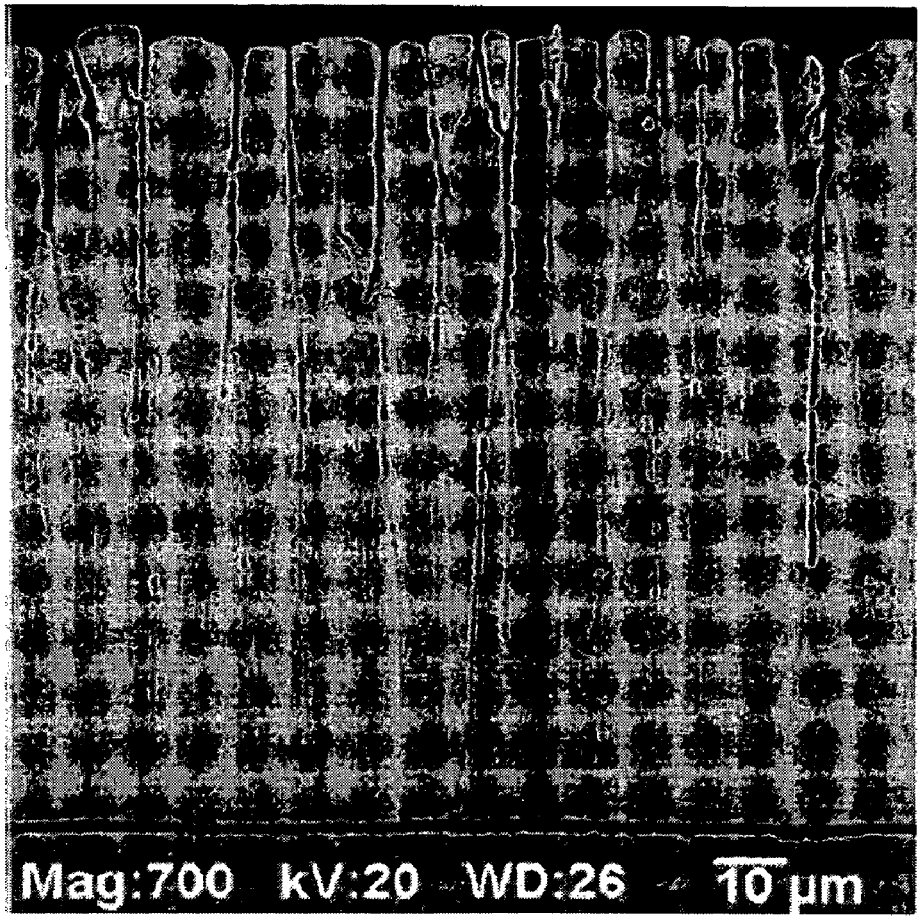
FIG. 2 is an electron micrograph of a cross-section of a nanolaminate thermal barrier coating, according to the invention.

Turbine shroud 14 may comprise either a superalloy or a ceramic material. NTBC 22 may be applied to inner surface 15 of turbine shroud 14 by EB-PVD. By way of non-limiting example, the EB-PVD process of the above referenced '537 patent may be used for applying nanolaminate TBC 22. The EB-PVD process may be conducted in a high-temperature environment. A high-energy electron beam may be focused and rastered across the end of an ingot comprising stabilized zirconia, hafnia or mixtures thereof, causing evaporation of the ingot. Rotating the inner surface 15 of turbine shroud 14 in the vapor from the ingot may produce a physical vapor deposition layer of stabilized zirconia, stabilized hafnia or mixtures thereof. NTBC 22 may be further formed by incorporating a secondary ingot comprising a metal oxide that may enable decoration of the deposition interfaces of stabilized zirconia and/or hafnia with the metal oxide. Due to slow deposition rates and rotation of turbine shroud 14, the columnar grains that may be formed may have several hundred deposition interfaces, or layers. Adding from about several hundred to about a few thousand layers may reduce thermal conductivity and make the grains of NTBC 22 more shearable during a high-speed rub. The microstructure of a NTBC 22 is illustrated in FIG. 2. Alternatively, NTBC 22 may be applied by plasma spraying. Deposition by EB-PVD or plasma spraying is well known in the art. The number of layers in and thickness of NTBC 22 may vary according to the dimensions of the engine and the blade tip clearance specifications for the engine. In one illustrative embodiment, NTBC 22 may have a thickness of from about 50 μm to about 2000 μm. In another illustrative embodiment, each individual layer in NTBC 22 may have a thickness of from about 50 nm to about 500 nm.

The thickness of the nanolayers may be equivalent. Alternatively, the thickness of the nanolayers may be varied. By way of non-limiting example, during deposition, the "soft" metal oxide layer may be made thicker from every about 10 nanolayers to about 100 nanolayers in order to promote shearing of the nanolaminate TBC 22, while maintaining the desirable low thermal conductivity. While not wishing to be bound by theory, it may be that the ideal nanolaminate microstructure for reduced thermal conductivity is probably different from that desired to promote shearing of the layers. During EB-PVD deposition it is easy to control the microstructure so that periodically a thicker more easily sheared layer may be deposited.

Figure 3:
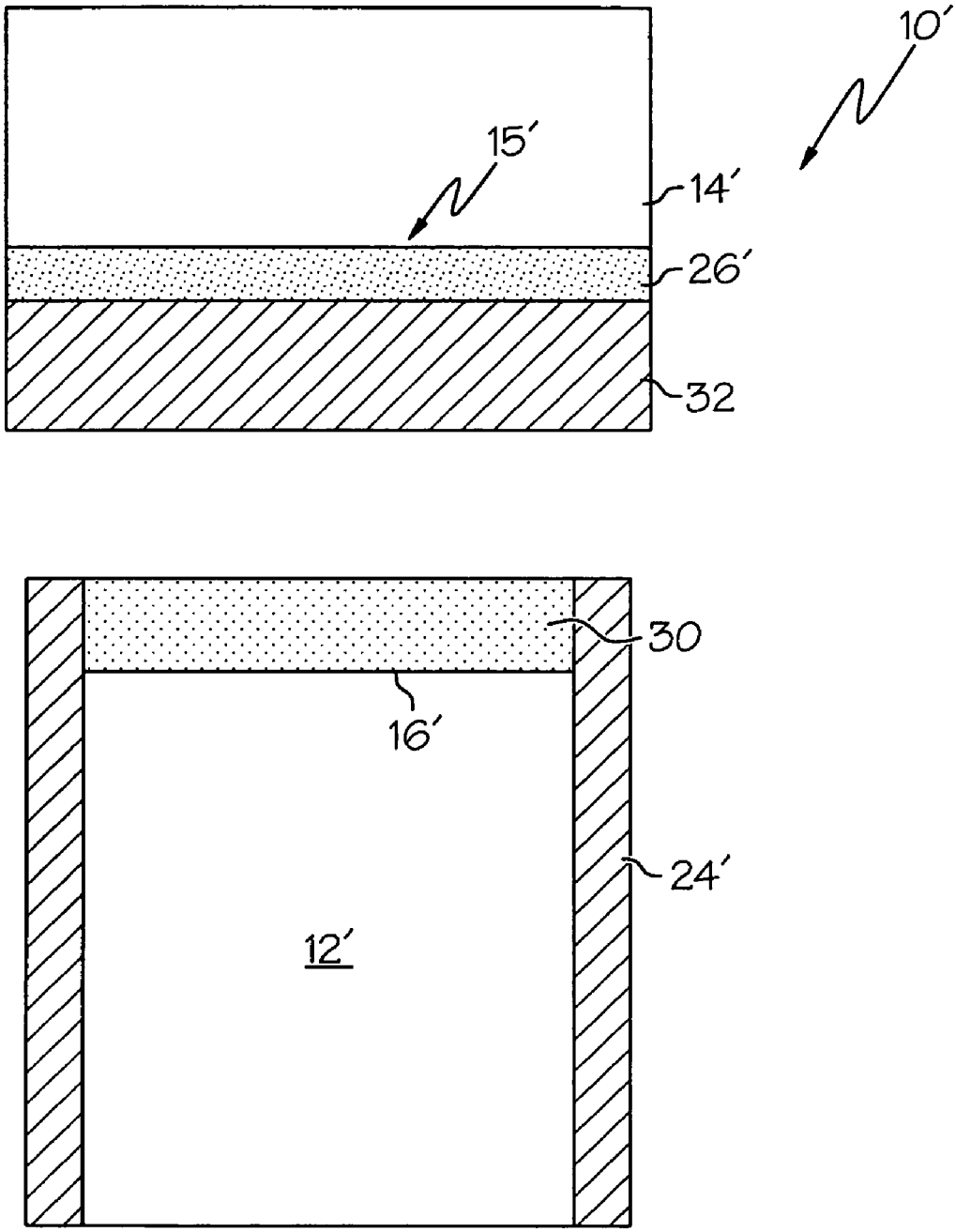
FIG. 3 shows a cross-section of a turbine blade and shroud of a gas turbine engine, according to another embodiment of the invention.

In an alternate embodiment, the present invention provides a turbine blade tip and shroud clearance control coating system 10' as shown in FIG. 3 comprising an abradable tip coating 30 on blade tip 16' of the turbine blade 12' and an abrasive shroud coating 32 on inner surface 15' of turbine shroud 14'. Abradable tip coating 30 may be an oxidation resistant bond coating such as, but not limited to, a resistant refractory metal silicide braze or a layer of alloyed tantalum oxide. In one illustrative embodiment, the refractory metal silicide braze may be $TiSi_2$+Si. In an alternate illustrative embodiment, the layer of alloyed tantalum oxide may be applied by EB-PVD. Alternatively, the abradable tip coating 30 may be the nanolaminate TBC used for NTBC 22.

Abrasive shroud coating 32 may be disposed on the inner surface 15' of turbine shroud 14' where abrasive shroud coating 32 may be complementary to the abradable tip coating 30. The abrasive shroud coating 32 may comprise stabilized tetragonal or cubic zirconia, stabilized tetragonal or cubic hafnia or mixtures thereof. The abrasive coating may be a thermal barrier coating. The abrasive shroud coating 32 may further comprise an oxidation resistant bond coating 26'. The oxidation resistant bond coating may be any coating that protects the base material turbine shroud 14' from oxidation during engine operation and provides and adherent surface for the thermal barrier coating 32. In one illustrative embodiment, turbine shroud 14' may comprise silicon nitride and the oxidation resistant bond coating may be a refractory metal suicide braze such as, but not limited to, $TaSi_2$+Si, or the oxidation resistant bond coating may be an alloyed tantalum oxide. In an alternate illustrative embodiment, turbine shroud 14' may comprise a nickel-based superalloy and the oxidation resistant bond coating may comprise a Pt-aluminide coating, a NiCoCrAlY coating or a NiCrAlY coating.

It should be understood, of course, that the foregoing relates to exemplary embodiments of the invention and that modifications may be made without departing from the spirit and scope of the invention as set forth in the following claims.

We claim:

1. A turbine blade tip and shroud clearance control coating system comprising:

a turbine blade, the turbine blade comprising a blade tip;

an abrasive grit coating disposed on the blade tip, the abrasive grit coating comprising an oxidation resistant bond coating and grit particles embedded into the oxidation resistant bond coating and grit particles embedded into the oxidation resistant bond coating, wherein the grit particles comprise abrasive crystalline particles of cubic zirconia, cubic hafnia or mixtures thereof;

a turbine shroud, the shroud comprising an inner surface, wherein the inner surface is in a rub relationship with the blade tip; and a nanolaminate thermal barrier coating on the inner surface of the turbine shroud, the nanolaminate thermal barrier coating comprising alternating layers of a first material with a second material, the first material comprising stabilized zirconia, hafnia or mixtures thereof, and the second material comprising at least one metal oxide, wherein the nanolaminate thermal barrier coating comprises from about 5 wt % to about 70 wt % of the metal oxide and from about 30 wt % to about 95 wt % of stabilized zirconia, hafnia or mixtures thereof.

2. The system of claim 1 wherein the turbine blade is a silicon nitride turbine blade and wherein the oxidation resistant bond coating comprises a refractory metal silicide braze.

3. The system of claim 2 wherein the refractory metal silicide braze is $TaSi_2$+Si.

4. The system of claim 1 wherein the turbine blade is a superalloy and wherein the oxidation resistant bond coating comprises NiCoCrAlY, NiCrAlY, or a Pt-aluminide.

5. The system of claim 1 wherein the abrasive crystalline particles have a diameter from about 50 μm to about 200 μm.

6. The system of claim 1 wherein the abrasive grit coating has a thickness of from about 50 μm to about 200 μm.

7. The system of claim 1 wherein the nanolaminate thermal barrier coating comprises from about 5 wt % to about 25 wt % of the metal oxide and from about 75 wt % to about 95 wt % of stabilized zirconia, hafnia or mixtures thereof.

8. The system of claim 1 wherein the metal oxide of the nanolaminate thermal barrier coating is tantalum oxide, alumina or niobium oxide.

9. The system of claim 1 wherein the nanolaminate thermal barrier coating is applied to the inner surface of the shroud by electron beam evaporation-physical vapor deposition or plasma spraying.

10. A turbine blade tip and shroud clearance control coating system comprising:

a silicon nitride turbine blade, the turbine blade comprising a blade tip;

an abrasive grit coating disposed on the blade tip, the abrasive grit coating comprising:

an oxidation resistant bond coating, the oxidation resistant bond coating comprising a refractory metal silicide braze;

grit particles embedded into the oxidation resistant bond coating, wherein the grit particles comprise abrasive crystalline particles of cubic zirconia, cubic hafnia or mixtures thereof;

a turbine shroud, the shroud comprising an inner surface, wherein the inner surface is in a rub relationship with the blade tip; and a nanolaminate thermal barrier coating on the inner surface of the turbine shroud, the nanolaminate thermal barrier coating comprising alternating nanolayers of a first material with a second material, the first material comprising stabilized zirconia, hafnia or mixtures thereof, and the second material comprising at least one metal oxide, wherein the alternating nanolayers have varying thicknesses.

11. The system of claim 10 wherein the refractory metal silicide braze is $TaSi_2$+Si.

12. The system of claim 10 wherein the nanolaminate thermal barrier coating has a melting temperature of at least about 3000° F.

13. The system of claim 10, farther comprising an inner layer disposed directly on the inner surface of the shroud, wherein the nanolaminate thermal barrier coating is disposed directly on the inner layer.

14. The system of claim 13, wherein the inner layer is a bond coating, an environmental barrier layer, or a second thermal barrier coating, wherein the second thermal barrier coating is different from the nanolaminate thermal barrier coating.

15. The system of claim 10, wherein the system is part of a gas turbine engine.

16. A turbine blade tip system comprising:

a turbine blade, the turbine blade comprising a blade tip; and an abrasive grit coating disposed on the blade tip, the abrasive grit coating comprising an oxidation resistant bond coating and grit particles embedded into the oxidation resistant bond coating, wherein the grit particles comprise abrasive crystalline particles of cubic hafnia.

17. The system of claim 16 wherein the turbine blade is a silicon nitride turbine blade and wherein the oxidation resistant bond coating comprises a refractory metal silicide braze.

18. The system of claim 16 wherein the turbine blade is a superalloy and wherein the oxidation resistant bond coating comprises NiCoCrAlY, NiCrAlY, or a Pt-aluminide.

19. The system of claim 16 wherein the abrasive crystalline particles have a diameter from about 50 μm to about 200 μm.

20. The system of claim 16 further comprising:

a turbine shroud, the shroud comprising an inner surface, wherein the inner surface is in a rub relationship with the blade tip; and a nanolaminate thermal barrier coating on the inner surface of the turbine shroud, the nanolaminate thermal barrier coating comprising alternating layers of a first material with a second material, the first material comprising stabilized zirconia, hafnia or mixtures thereof, and the second material comprising at least one metal oxide.

* * * * *

UNITED STATES PATENT AND TRADEMARK OFFICE

CERTIFICATE OF CORRECTION

PATENT NO. : 7,510,370 B2
APPLICATION NO. : 11/227780
DATED : March 31, 2009
INVENTOR(S) : Thomas E. Strangman et al.

It is certified that error appears in the above-identified patent and that said Letters Patent is hereby corrected as shown below:

Column 8, line 1, claim 13 “farther” should be changed to --further--

Signed and Sealed this

Seventh Day of July, 2009

JOHN DOLL
*Acting Director of the United States Patent and Trademark Office*